US008777780B2

(12) United States Patent
Kamino et al.

(10) Patent No.: US 8,777,780 B2
(45) Date of Patent: Jul. 15, 2014

(54) GOLF BALL

(75) Inventors: Kazuya Kamino, Kobe (JP); Keiji Ohama, Kobe (JP)

(73) Assignee: SRI Sports Limited, Kobe (JP)

( * ) Notice: Subject to any disclaimer, the term of this patent is extended or adjusted under 35 U.S.C. 154(b) by 513 days.

(21) Appl. No.: 12/545,222

(22) Filed: Aug. 21, 2009

(65) Prior Publication Data

US 2010/0069175 A1 Mar. 18, 2010

(30) Foreign Application Priority Data

Sep. 18, 2008 (JP) ..... 2008-239437

(51) Int. Cl.
*A63B 37/06* (2006.01)

(52) U.S. Cl.
USPC ..... 473/376

(58) Field of Classification Search
USPC ..... 473/376, 368
See application file for complete search history.

(56) References Cited

U.S. PATENT DOCUMENTS 5,816,937 A 10/1998 Shimosaka et al.
6,277,036 B1 8/2001 Hayashi et al.
6,354,967 B1 * 3/2002 Nakamura et al. ..... 473/378
6,685,579 B2 * 2/2004 Sullivan ..... 473/357
7,131,915 B2 * 11/2006 Sullivan et al. ..... 473/376
7,278,930 B2 * 10/2007 Yokota et al. ..... 473/378
2002/0119840 A1 8/2002 Higuchi et al.
2007/0281804 A1 12/2007 Kamino et al.
2008/0146377 A1 6/2008 Watanabe

FOREIGN PATENT DOCUMENTS

JP 2007-319589 A 12/2007
JP 2008-149130 A 7/2008

* cited by examiner

*Primary Examiner* — Raeann Gorden
(74) *Attorney, Agent, or Firm* — Birch, Stewart, Kolasch & Birch, LLP

(57) ABSTRACT

A golf ball 2 includes a spherical core 4, an envelope layer 6 positioned outside the core 4, a mid layer 8 positioned outside the envelope layer 6, a reinforcing layer 10 positioned outside the mid layer 8, and a cover 12 positioned outside the reinforcing layer 10. The mid layer 8 has a thickness Tm less than 1.0 mm. The envelope layer 6 has a Shore D hardness Hs of 60 or greater. The mid layer 8 has a Shore D hardness Hm of 50 or greater and 65 or less. The cover 12 has a Shore D hardness Hc less than 40. The golf ball 2 satisfies that Hs>Hm>Hc. The principal components of the base materials of the envelope layer 6, the mid layer 8 and the cover 12 are an ionomer resin, an ionomer resin and a thermoplastic polyurethane elastomer, respectively.

16 Claims, 1 Drawing Sheet

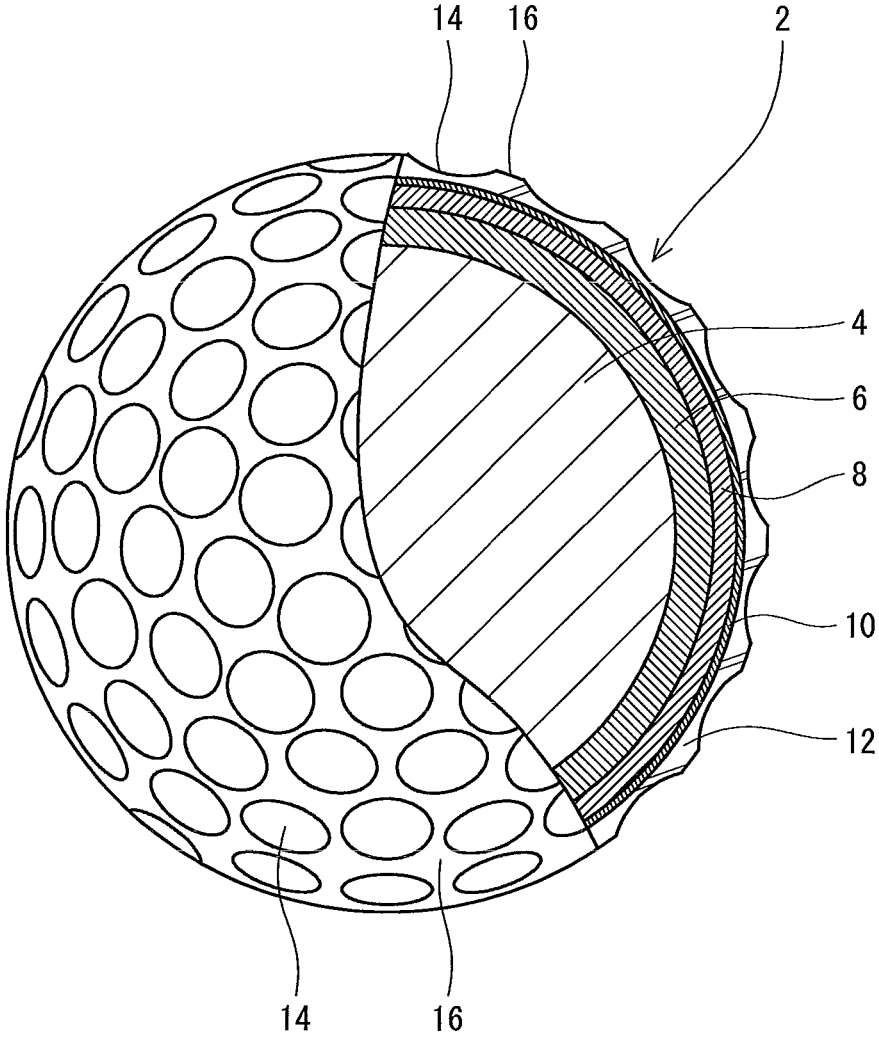
14
16
2
4
6
8
10
12
14
16

GOLF BALL

This application claims priority on Patent Application No. 2008-239437 filed in JAPAN on Sep. 18, 2008. The entire contents of this Japanese Patent Application are hereby incorporated by reference.

BACKGROUND OF THE INVENTION

1. Field of the Invention

The present invention relates to golf balls. Specifically, the present invention relates to multi-piece golf balls including a core, an envelope layer, a mid layer and a cover.

2. Description of the Related Art

The greatest interest to golf players concerning golf balls is flight performance. In particular, golf players place importance on a flight distance upon a shot with a driver. By using a golf ball that has a long flight distance upon a shot with a driver, golf players can hit a second shot at a point close to the green. A flight distance upon a shot with a driver correlates with a spin rate. A golf ball with a low spin rate has excellent flight performance. In addition, flight performance correlates with the resilience performance of a golf ball.

Golf players also place importance on spin performance of golf balls. If a backspin rate is high, the run is short. By using a golf ball that has a high backspin rate, golf players can cause the golf ball to stop at a target point. If a sidespin rate is high, the golf ball tends to curve. By using a golf ball that has a high sidespin rate, golf players can intentionally cause the golf ball to curve. A golf ball with excellent spin performance has excellent controllability. In particular, advanced golf players place importance on controllability upon a shot with a short iron.

Golf players also place importance on feel at impact of golf balls. In general, golf players prefer soft feel at impact.

Golf balls with a cover including a polyurethane are commercially available. In general, polyurethanes are flexible. Spin is easily given to this golf ball. This cover contributes to the controllability. On the other hand, if this golf ball is hit with a driver, this cover causes excessive spin. This cover impairs the flight performance.

Golf balls with a core and a thin cover formed from a polyurethane are commercially available. This core includes a center and a mid layer. The mid layer is formed from a hard synthetic resin. This mid layer achieves an outer-hard/inner-soft structure of the core. When this golf ball is hit with a driver, the core deforms significantly because the cover is thin. The outer-hard/inner-soft structure of the core suppresses spin. This core achieves a long flight distance upon a shot with a driver. When this golf ball is hit with a short iron, a high spin rate is achieved by the flexible cover. This cover contributes to the controllability upon a shot with a short iron. This golf ball has hard feel at impact because the cover is thin and the mid layer is hard.

There have been various proposals intended to improve various performance characteristics of golf balls. U.S. Pat. No. 5,816,937 (JPH9-248351A) discloses a golf ball including a core, an inner cover, a mid cover and an outer cover. U.S. Pat. No. 6,277,036 (JP2000-60998A) discloses a golf ball including a core, an envelope layer, a mid layer and a cover. US2002/119840 (JP2002-191719A) discloses a golf ball including a core, an inner cover, a mid cover and an outer cover.

In the golf ball disclosed in U.S. Pat. No. 5,816,937, the mid cover is hard. This golf ball has inferior feel at impact. In the golf ball disclosed in U.S. Pat. No. 6,277,036, the envelope layer is flexible. This golf ball has excessive spin upon a shot with a driver. In the golf ball disclosed in US2002/119840, the outer cover is hard. This golf ball has insufficient spin upon a shot with a short iron.

Golf players' requirements for golf balls have been escalated more than ever. An objective of the present invention is to provide a golf ball having excellent flight performance, excellent controllability, and excellent feel at impact.

SUMMARY OF THE INVENTION

A golf ball according to the present invention comprises a core, an envelope layer positioned outside the core, a mid layer positioned outside the envelope layer, and a cover positioned outside the mid layer. The mid layer has a thickness Tm less than 1.0 mm. The envelope layer has a Shore D hardness Hs of 60 or greater. The mid layer has a Shore D hardness Hm of 50 or greater and 65 or less. The cover has a Shore D hardness Hc less than 40. The hardness Hs, the hardness Hm and the hardness Hc satisfy the following mathematical formula.

$$Hs>Hm>Hc$$

When the golf ball according to the present invention is hit with a short iron, the cover deforms significantly. Because the cover is flexible, the spin rate is high when the golf ball is hit with a short iron. The cover achieves excellent controllability. When the golf ball is hit with a driver, the envelope layer and the core significantly deform together with the cover and the mid layer. Because the envelope layer has a high hardness, a sphere consisting of the envelope layer and the core has an outer-hard/inner-soft structure. The outer-hard/inner-soft structure suppresses spin. Because of a low spin rate, a long flight distance is obtained upon a shot with a driver. Because the hardness of the mid layer is less than that of the envelope layer and greater than that of the cover, soft feel at impact is achieved by the mid layer. The golf ball has excellent flight performance, excellent controllability and excellent feel at impact.

Preferably, the core has a diameter of 35.0 mm or greater and 42.0 mm or less. Preferably, the envelope layer has a thickness Ts of 0.5 mm or greater and 2.4 mm or less. Preferably, the cover has a thickness Tc of 1.0 mm or less. Preferably, the sum (Tm+Tc) of the thickness Tm of the mid layer and the thickness Tc of the cover is equal to or greater than 0.2 mm and equal to or less than 1.6 mm.

The core can be formed by crosslinking a rubber composition. Preferably, the principal component of the base material of the rubber composition is a polybutadiene. Preferably, the core has a central hardness H1 of 35 or greater and 80 or less, which is measured with a JIS-C type hardness scale. Preferably, the core has a surface hardness H2 of 45 or greater and 100 or less, which is measured with a JIS-C type hardness scale. Preferably, the difference (H2−H1) is equal to or greater than 5 and equal to or less than 35.

Preferably, the principal component of the base material of the envelope layer is an ionomer resin. Preferably, the principal component of the base material of the mid layer is an ionomer resin. Preferably, the principal component of the base material of the cover is a thermoplastic polyurethane elastomer.

Preferably, the hardness Hs is greater than a surface hardness of the core. Preferably, the difference (Hs−Hm) between the hardness Hs and the hardness Hm is equal to or greater than 3 and equal to or less than 30. Preferably, the difference (Hm−Hc) between the hardness Hm and the hardness Hc is equal to or greater than 5 and equal to or less than 35.

Preferably, the core has an amount of compressive deformation D1 of 2.3 mm or greater and 5.0 mm or less. Preferably, a sphere consisting of the core and the envelope layer has an amount of compressive deformation of 2.0 mm or greater and 3.8 mm or less. Preferably, a sphere consisting of the core, the envelope layer and the mid layer has an amount of compressive deformation of 2.3 mm or greater and 4.0 mm or less. Preferably, the golf ball has an amount of compressive deformation of 1.9 mm or greater and 3.5 mm or less.

Preferably, the golf ball further comprises a reinforcing layer positioned between the mid layer and the cover. The reinforcing layer has a thickness of 3 μm or greater and 30 μm or less.

BRIEF DESCRIPTION OF THE DRAWINGS

FIG. 1 is a schematic cross-sectional view of a golf ball according to an embodiment of the present invention.

DESCRIPTION OF THE PREFERRED EMBODIMENTS

The following will describe in detail the present invention based on preferred embodiments with reference to the accompanying drawing.

Golf ball 2 shown in FIG. 1 includes a spherical core 4, an envelope layer 6 positioned outside the core 4, a mid layer 8 positioned outside the envelope layer 6, a reinforcing layer 10 positioned outside the mid layer 8, and a cover 12 positioned outside the reinforcing layer 10. On the surface of the cover 12, a large number of dimples 14 are formed. Of the surface of the golf ball 2, a part other than the dimples 14 is a land 16. The golf ball 2 includes a paint layer and a mark layer on the external side of the cover 12 although these layers are not shown in the drawing.

The golf ball 2 has a diameter of 40 mm or greater and 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater and 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

The core 4 is obtained by crosslinking a rubber composition. Examples of preferable base rubbers for use in the rubber composition include polybutadienes, polyisoprenes, styrene-butadiene copolymers, ethylene-propylene-diene copolymers and natural rubbers. In light of resilience performance, polybutadienes are preferred. When another rubber is used in combination with a polybutadiene, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40 mol % and more preferably equal to or greater than 80 mol %.

In order to crosslink the core 4, a co-crosslinking agent is preferably used. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate and magnesium methacrylate. In light of resilience performance, zinc acrylate and zinc methacrylate are particularly preferred.

In light of resilience performance of the golf ball 2, the amount of the co-crosslinking agent is preferably equal to or greater than 10 parts by weight and more preferably equal to or greater than 15 parts by weight, per 100 parts by weight of the base rubber. In light of soft feel at impact, the amount of the co-crosslinking agent is preferably equal to or less than 50 parts by weight and more preferably equal to or less than 45 parts by weight, per 100 parts by weight of the base rubber.

Preferably, the rubber composition of the core 4 includes an organic peroxide together with a co-crosslinking agent. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. In light of versatility, dicumyl peroxide is preferred.

In light of resilience performance of the golf ball 2, the amount of the organic peroxide is preferably equal to or greater than 0.1 part by weight, more preferably equal to or greater than 0.3 part by weight, and particularly preferably equal to or greater than 0.5 part by weight, per 100 parts by weight of the base rubber. In light of soft feel at impact, the amount of the organic peroxide is preferably equal to or less than 3.0 parts by weight, more preferably equal to or less than 2.5 parts by weight, and particularly preferably equal to or less than 2.0 parts by weight, per 100 parts by weight of the base rubber.

Preferably, the rubber composition of the core 4 includes an organic sulfur compound. Examples of preferable organic sulfur compounds include monosubstitutions such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; disubstitutions such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; trisubstitutions such as bis(2,4,6-trichlorophenyl)disulfide and bis(2-cyano-4-chloro-6-bromophenyl)disulfide; tetrasubstitutions such as bis(2,3,5,6-tetrachlorophenyl)disulfide; and pentasubstitutions such as bis(2,3,4,5,6-pentachlorophenyl)disulfide and bis(2,3,4,5,6-pentabromophenyl)disulfide. The organic sulfur compound contributes to the resilience performance of the golf ball 2. Particularly preferable organic sulfur compounds are diphenyl disulfide and bis(pentabromophenyl)disulfide.

In light of resilience performance, the amount of the organic sulfur compound is preferably equal to or greater than 0.1 part by weight and more preferably equal to or greater than 0.2 part by weight, per 100 parts by weight of the base rubber. In light of soft feel at impact, the amount of the organic sulfur compound is preferably equal to or less than 1.5 parts by weight and more preferably equal to or less than 1.0 part by weight, per 100 parts by weight of the base rubber.

For the purpose of adjusting specific gravity and the like, a filler may be included in the core 4. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the core 4 is accomplished. A particularly preferable filler is zinc oxide. Zinc oxide serves not only as a specific gravity adjuster but also as a crosslinking activator. According to need, various additives such as sulfur, an anti-aging agent, a coloring agent, a plasticizer, a dispersant, and the like are included in the core 4 in an adequate amount. Crosslinked rubber powder or synthetic resin powder may be also included in the core 4.

In light of resilience performance, the core 4 has a central hardness H1 of preferably 35 or greater, more preferably 40 or greater, and particularly preferably 45 or greater. In light of suppression of spin upon a shot with a driver, the central hardness H1 is preferably equal to or less than 80, more preferably equal to or less than 75, and particularly preferably equal to or less than 70. The central hardness H1 is measured by pressing a JIS-C type hardness scale against the central point of a cut plane of the core 4 that has been cut into two halves. For the measurement, an automated rubber hardness measurement machine (trade name "P1", available from Kobunshi Keiki Co., Ltd.), to which this hardness scale is mounted, is used.

In light of resilience performance, the core 4 has a surface hardness H2 of preferably 45 or greater, more preferably 50 or greater, and particularly preferably 55 or greater. In light of feel at impact, the surface hardness H2 is preferably equal to or less than 100, more preferably equal to or less than 95, and particularly preferably equal to or less than 90. The surface hardness H2 is measured by pressing a JIS-C type hardness scale against the surface of the core 4. For the measurement, an automated rubber hardness measurement machine (trade name "P1", available from Kobunshi Keiki Co., Ltd.), to which this hardness scale is mounted, is used.

In light of suppression of spin and feel at impact, the difference (H2−H1) between the surface hardness H2 and the central hardness H1 is preferably equal to or greater than 5, more preferably equal to or greater than 8, and particularly preferably equal to or greater than 12. In light of resilience performance, the difference (H2−H1) is preferably equal to or less than 35, more preferably equal to or less than 32, and particularly preferably equal to or less than 30.

In light of feel at impact, the core 4 has an amount of compressive deformation D1 of preferably 2.3 mm or greater, more preferably 2.4 mm or greater, and particularly preferably 2.5 mm or greater. In light of resilience performance, the amount of compressive deformation D1 is preferably equal to or less than 5.0 mm, more preferably equal to or less than 4.5 mm, and particularly preferably equal to or less than 4.0 mm.

Upon measurement of the amount of compressive deformation, a sphere (the core 4, the golf ball 2, and the like) is placed on a hard plate made of metal. A cylinder made of metal gradually descends toward the sphere. The sphere, squeezed between the bottom face of the cylinder and the hard plate, becomes deformed. A migration distance of the cylinder, starting from the state in which an initial load of 98 N is applied to the sphere up to the state in which a final load of 1274 N is applied thereto, is the amount of compressive deformation.

The core 4 contributes to the resilience performance of the golf ball 2. In light of resilience performance, the core 4 has a diameter of preferably 35.0 mm or greater, more preferably 36.0 mm or greater, and particularly preferably 37.0 mm or greater. In light of forming the envelope layer 6 with a sufficient thickness, the diameter is preferably equal to or less than 41.6 mm and particularly preferably equal to or less than 41.2 mm.

The core 4 has a weight of preferably 25 g or greater and 42 g or less. The temperature for crosslinking the core 4 is generally equal to or higher than 140° C. and equal to or lower than 180° C. The time period for crosslinking the core 4 is generally equal to or longer than 10 minutes and equal to or shorter than 60 minutes. The core 4 may be formed with two or more layers. The core 4 may have a rib on the surface thereof.

A resin composition is preferably used for the envelope layer 6. Examples of the base polymer of this resin composition include ionomer resins, styrene block-containing thermoplastic elastomers, thermoplastic polyurethane elastomers, thermoplastic polyamide elastomers, thermoplastic polyester elastomers, and thermoplastic polyolefin elastomers. Particularly, ionomer resins are preferred. Ionomer resins are highly elastic. As described later, the mid layer 8 and the cover 12 of the golf ball 2 are thin. When the golf ball 2 is hit with a driver, the envelope layer 6 significantly deforms due to the thinness of the mid layer 8 and the cover 12. The envelope layer 6 including an ionomer resin contributes to the resilience performance upon a shot with a driver.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. This binary copolymer provides excellent resilience performance to the golf ball 2. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. This ternary copolymer provides excellent resilience performance to the golf ball 2. For the binary copolymer and ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and ternary copolymer, some of the carboxyl groups are neutralized with metal ions. Examples of metal ions for use in neutralization include sodium ion, potassium ion, lithium ion, zinc ion, calcium ion, magnesium ion, aluminum ion and neodymium ion. The neutralization may be carried out with two or more types of metal ions. Particularly suitable metal ions in light of resilience performance and durability of the golf ball 2 are sodium ion, zinc ion, lithium ion and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan MK7320" and "Himilan MK7329", available from Du Pont-MITSUI POLYCHEMICALS Co., Ltd.; trade names "Surlyn 6120", "Surlyn 6320", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000" and "HPF2000", available from E.I. du Pont de Nemours and Company; and trade names "IOTEK 7010", "IOTEK 7030", "IOTEK 7510", "IOTEK 7520", "IOTEK 8000" and "IOTEK 8030", available from ExxonMobil Chemical Corporation. Two or more types of ionomer resins may be used in combination. An ionomer resin neutralized with a monovalent metal ion, and an ionomer resin neutralized with a bivalent metal ion may be used in combination.

As described later, the envelope layer 6 is hard. Use of an ionomer resin having a high acid content achieves a hard envelope layer 6. The acid content is preferably equal to or greater than 10% by weight and equal to or less than 30% by weight. Specific examples of ionomer resins having a high acid content include the aforementioned "Himilan 1605", "Himilan 1706", "Himilan 1707", "Himilan AM7311", "Himilan AM7317", "Himilan AM7318", "Himilan AM7329", "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "IOTEK 8000" and "IOTEK 8030".

The envelope layer 6 is hard. The golf ball 2 with the hard envelope layer 6 has excellent resilience performance upon a shot with a driver. A sphere consisting of the hard envelope layer 6 and the core 4 can achieve an outer-hard/inner-soft hardness distribution. When the golf ball 2 having this hardness distribution is hit with a driver, the spin is suppressed. The synergistic effect of the resilience performance and the spin suppression achieves excellent flight performance of the golf ball 2. The golf ball 2 having this hardness distribution also has excellent feel at impact. In light of flight performance and feel at impact, the envelope layer 6 has a Shore D hardness Hs of preferably 60 or greater, more preferably 62 or greater, and particularly preferably 64 or greater. In light of feel at impact and durability, the hardness Hs is preferably equal to or less than 80, more preferably equal to or less than 75, and particularly preferably equal to or less than 72.

In the present invention, the hardness Hs of the envelope layer 6 is measured according to the standards of "ASTM-D 2240-68". For the measurement, an automated rubber hardness measurement machine (trade name "P1", available from Kobunshi Keiki Co., Ltd.), to which a Shore D type hardness scale is mounted, is used. For the measurement, a sheet, which is formed by hot press and made of the same material as the envelope layer 6 and which has a thickness of about 2 mm, is used. Prior to the measurement, the sheet is maintained at 23° C. for two weeks. At the measurement, three sheets are stacked.

In light of flight performance, the envelope layer 6 has a thickness Ts of preferably 0.5 mm or greater, more preferably 0.7 mm or greater, and particularly preferably 0.8 mm or greater. In light of feel at impact, the thickness Ts is preferably equal to or less than 2.4 mm, more preferably equal to or less than 2.1 mm, and particularly preferably equal to or less than 1.7 mm.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the envelope layer 6 in an adequate amount. For the purpose of adjusting specific gravity, powder of a metal with a high specific gravity such as tungsten, molybdenum and the like may be included in the envelope layer 6.

For forming the envelope layer 6, known methods such as injection molding, compression molding and the like can be used. In light of productivity, injection molding is preferred.

In light of feel at impact, the sphere consisting of the core 4 and the envelope layer 6 has an amount of compressive deformation D2 of preferably 2.0 mm or greater, more preferably 2.1 mm or greater, and particularly preferably 2.2 mm or greater. In light of resilience performance, the amount of compressive deformation D2 is preferably equal to or less than 3.8 mm, more preferably equal to or less than 3.7 mm, and particularly preferably equal to or less than 3.6 mm.

The mid layer 8 is formed from a resin composition. Examples of the base polymer of this resin composition include ionomer resins, styrene block-containing thermoplastic resin elastomers, thermoplastic polyurethane elastomers, thermoplastic polyamide elastomers, thermoplastic polyester elastomers and thermoplastic polyolefin elastomers. Particularly, ionomer resins are preferred. Ionomer resins are highly elastic. As described later, the cover 12 of the golf ball 2 is thin. When the golf ball 2 is hit with a driver, the mid layer 8 significantly deforms due to the thinness of the cover 12. The mid layer 8 including an ionomer resin contributes to the resilience performance upon a shot with a driver. The ionomer resin described above for the envelope layer 6 can be used for the mid layer 8.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight.

A preferable resin that can be used in combination with an ionomer resin is a styrene block-containing thermoplastic elastomer. This elastomer can contribute to the feel at impact of the golf ball 2. This elastomer does not impair the resilience performance of the golf ball 2. This elastomer includes a polystyrene block as a hard segment, and a soft segment. A typical soft segment is a diene block. Examples of diene compounds include butadiene, isoprene, 1,3-pentadiene and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include alloys of olefin and one or more selected from the group consisting of SBS, SIS, SIBS, SEBS, SEPS, SEEPS and hydrogenated products thereof. An olefin component in the alloy is presumed to contribute to the improvement of compatibility with ionomer resins. Use of this alloy improves the resilience performance of the golf ball 2. An olefin having 2 to 10 carbon atoms is preferably used. Examples of suitable olefins include ethylene, propylene, butene and pentene. Ethylene and propylene are particularly preferred.

Specific examples of polymer alloys include trade names "Rabalon T3221C", "Rabalon T3339C" "Rabalon SJ4400N", "Rabalon SJ5400N", "Rabalon SJ6400N", "Rabalon SJ7400N", "Rabalon SJ8400N", "Rabalon SJ9400N" and "Rabalon SR04", available from Mitsubishi Chemical Corporation. Other specific examples of styrene block-containing thermoplastic elastomers include a trade name "Epofriend A1010" available form Daicel Chemical Industries, Ltd., and a trade name "Septon HG-252" available from Kuraray Co., Ltd.

When an ionomer resin and a styrene block-containing thermoplastic elastomer are used in combination for the mid layer 8, the weight ratio of them is preferably equal to or greater than 50/50 and equal to or less than 97/3. The mid layer 8 with a weight ratio of 50/50 or greater contributes to the resilience performance of the golf ball 2. In this respect, the ratio is more preferably equal to or greater than 70/30 and particularly preferably equal to or greater than 85/15. The mid layer 8 with a weight ratio of 97/3 or less contributes to the feel at impact of the golf ball 2. In this respect, the ratio is more preferably equal to or less than 95/10.

The mid layer 8 has a Shore D hardness Hm of preferably 50 or greater and 65 or less. The mid layer 8 with a hardness Hm of 50 or greater does not impair the resilience performance of the golf ball 2. In this respect, the hardness Hm is more preferably equal to or greater than 52 and particularly preferably equal to or greater than 54. The mid layer 8 with a hardness Hm of 65 or less contributes to the feel at impact of the golf ball 2. In this respect, the hardness Hm is more preferably equal to or less than 60 and particularly preferably equal to or less than 57. The hardness Hm of the mid layer 8 is measured by the same method as that for the hardness Hs of the envelope layer 6.

The mid layer 8 has a thickness Tm less than 1.0 mm. As described later, the hardness of the mid layer 8 is less than that of the envelope layer 6. The mid layer 8 is disadvantageous to the resilience coefficient of the golf ball 2. Upon a shot with a driver, the core 4 and the envelope layer 6 also deform significantly. By setting the thickness Tm to be less than 1.0 mm, the mid layer 8 does not have a significantly adverse effect on the resilience coefficient upon a shot with a driver, even if the mid layer 8 is flexible. The mid layer 8 with a thickness Tm less than 1.0 mm does not impair the flight performance of the golf ball 2. In light of flight performance, the thickness Tm is preferably equal to or less than 0.8 mm and particularly preferably equal to or less than 0.6 mm. In light of feel at impact, the thickness Tm of the mid layer 8 is preferably equal to or greater than 0.1 mm, more preferably equal to or greater than 0.2 mm, and particularly preferably equal to or greater than 0.3 mm.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the mid layer 8 in an adequate amount. For the purpose of adjusting specific gravity, powder of a metal with a high specific gravity such as tungsten, molybdenum, and the like may be included in the mid layer 8.

For forming the mid layer 8, known methods such as injection molding, compression molding and the like can be used. In light of productivity, injection molding is preferred.

In light of feel at impact, a sphere consisting of the core 4, the envelope layer 6 and the mid layer 8 has an amount of compressive deformation D3 of preferably 2.3 mm or greater, more preferably 2.4 mm or greater, and particularly preferably 2.5 mm or greater. In light of resilience performance, the amount of compressive deformation D3 is preferably equal to or less than 4.0 mm, more preferably equal to or less than 3.9 mm, and particularly preferably equal to or less than 3.8 mm.

The reinforcing layer 10 is positioned between the mid layer 8 and the cover 12. The reinforcing layer 10 firmly adheres to the mid layer 8 and also to the cover 12. The reinforcing layer 10 prevents separation of the cover 12 from the mid layer 8. As described later, the cover 12 of the golf ball 2 is thin. When the golf ball 2 is hit by the leading edge of a golf club, a wrinkle is likely to occur. The reinforcing layer 10 prevents a wrinkle from occurring.

As the base polymer of the reinforcing layer 10, a two-component curing type thermosetting resin is suitably used. Examples of two-component curing type thermosetting resins include epoxy resins, urethane resins, acrylic resins, polyester resins and cellulose resins. In light of strength and durability of the reinforcing layer 10, two-component curing type epoxy resins and two-component curing type urethane resins are preferred.

The reinforcing layer 10 may include additives such as a coloring agent (typically, titanium dioxide), a phosphate-based stabilizer, an antioxidant, a light stabilizer, a fluorescent brightener, an ultraviolet absorber, an anti-blocking agent and the like. The additives may be added to the base material of the two-component curing thermosetting resin, or may be added to the curing agent of the two-component curing thermosetting resin.

The reinforcing layer 10 is obtained by applying, to the surface of the mid layer 8, a liquid that is prepared by dissolving or dispersing the base material and the curing agent in a solvent. In light of workability, application with a spray gun is preferred. After the application, the solvent is volatilized to permit a reaction of the base material with the curing agent, thereby forming the reinforcing layer 10.

In light of prevention of a wrinkle, the reinforcing layer 10 has a thickness of preferably 3 μm or greater and more preferably 5 μm or greater. In light of durability of the reinforcing layer 10, the thickness is preferably equal to or less than 30 μm, more preferably equal to or less than 20 μm, and particularly preferably equal to or less than 10 μm. The thickness is measured by observing a cross section of the golf ball 2 with a microscope. When the mid layer 8 has concavities and convexities on its surface from surface roughening, the thickness of the reinforcing layer 10 is measured at a convex part.

In light of prevention of a wrinkle, the reinforcing layer 10 has a pencil hardness of preferably 4B or harder and more preferably B or harder. In light of reduced loss of the power transmission from the cover 12 to the mid layer 8 upon a hit of the golf ball 2, the reinforcing layer 10 has a pencil hardness of preferably 3H or softer. The pencil hardness is measured according to the standards of "JIS K5400".

When the cover 12 sufficiently adheres to the mid layer 8, the reinforcing layer 10 may not be provided therebetween.

The cover 12 is formed from a resin composition. Examples of the base polymer of this resin composition include polyurethanes, polyesters, polyamides, polyolefins, polystyrenes and ionomer resins. Particularly, polyurethanes are preferred. Polyurethanes are flexible. When the golf ball 2 with the cover 12 including a polyurethane is hit with a short iron, the spin rate is high. The cover 12 formed from a polyurethane contributes to the controllability upon a shot with a short iron. The polyurethane also contributes to the scuff resistance of the cover 12.

When the golf ball 2 is hit with a driver, a long iron, or a middle iron, the sphere consisting of the core 4 and the envelope layer 6 becomes significantly distorted because the head speed is high. Because this sphere has an outer-hard/inner-soft structure as described above, the spin is suppressed. When the golf ball 2 is hit with a short iron, this sphere becomes less distorted because the head speed is low. When the golf ball 2 is hit with a short iron, the behavior of the golf ball 2 mainly depends on the cover 12. Because of the cover 12 including the polyurethane, a high spin rate is obtained when the golf ball 2 is hit with a short iron, even though the above sphere has the outer-hard/inner-soft structure. This high spin rate achieves excellent controllability.

A polyurethane and another resin may be used in combination for the cover 12. In this case, in light of spin performance and feel at impact, the polyurethane is included as the principal component of the base polymer. The proportion of the polyurethane to the entire base polymer is preferably equal to or greater than 50% by weight, more preferably equal to or greater than 70% by weight, and particularly preferably equal to or greater than 85% by weight.

For the cover 12, thermoplastic polyurethanes and thermosetting polyurethanes can be used. In light of productivity, thermoplastic polyurethanes are preferred. A thermoplastic polyurethane includes a polyurethane component as a hard segment, and a polyester component or a polyether component as a soft segment. Examples of the curing agent for the polyurethane component include alicyclic diisocyanates, aromatic diisocyanates and aliphatic diisocyanates. Alicyclic diisocyanates are particularly preferred. Because an alicyclic diisocyanate does not have any double bond in the main chain, the alicyclic diisocyanate suppresses yellowing of the cover 12. In addition, because the alicyclic diisocyanate has excellent strength, the alicyclic diisocyanate prevents the cover 12 from being damaged. Two or more types of diisocyanates may be used in combination.

Examples of alicyclic diisocyanates include 4,4'-dicyclohexylmethane diisocyanate ($H_{12}$MDI), 1,3-bis(isocyanatemethyl)cyclohexane ($H_6$XDI), isophorone diisocyanate (IPDI) and trans-1,4-cyclohexane diisocyanate (CHDI). In light of versatility and processability, $H_{12}$MDI is preferred.

Examples of aromatic diisocyanates include 4,4'-diphenylmethane diisocyanate (MDI) and toluene diisocyanate (TDI). One example of aliphatic diisocyanates is hexamethylene diisocyanate (HDI).

Specific examples of thermoplastic polyurethanes include trade names "Elastollan XNY80A", "Elastollan XNY85A", "Elastollan XNY90A", "Elastollan XNY97A", "Elastollan XNY585" and "Elastollan XKP016N", available from BASF Japan Ltd.; and trade names "RESAMINE P4585LS" and "RESAMINE PS62490", available from Dainichiseika Color & Chemicals Mfg. Co., Ltd.

The cover 12 may be formed from a composition including a thermoplastic polyurethane and an isocyanate compound. During or after forming the cover 12, the polyurethane is crosslinked with the isocyanate compound.

The cover 12 has a Shore D hardness Hc less than 40. Use of the flexible cover 12 can achieve excellent controllability upon a shot with a short iron. In light of controllability, the hardness Hc is more preferably equal to or less than 38, even more preferably equal to or less than 36, and particularly preferably equal to or less than 30. If the hardness Hc is excessively small, the flight performance upon a shot with a driver is insufficient. In this respect, the hardness Hc is preferably equal to or greater than 10, more preferably equal to or greater than 15, and particularly preferably equal to or greater than 20. The hardness Hc of the cover 12 is measured by the same method as that for the hardness Hs of the envelope layer 6.

The cover 12 has a thickness Tc of 1.0 mm or less. As described above, the cover 12 is flexible. The cover 12 is disadvantageous to the resilience coefficient of the golf ball 2. Upon a shot with a driver, the core 4 and the envelope layer 6 also deform significantly. By setting the thickness Tc to be equal to or less than 1.0 mm, the cover 12 does not have a significantly adverse effect on the resilience coefficient upon a shot with a driver, even if the cover 12 is flexible. The cover 12 with a thickness Tc of 1.0 mm or less does not impair the flight performance of the golf ball 2. In light of flight performance, the thickness Tc is more preferably equal to or less than 0.8 mm, even more preferably equal to or less than 0.5 mm, and particularly preferably equal to or less than 0.4 mm. In light of controllability upon a shot with a short iron, the thickness Tc is preferably equal to or greater than 0.1 mm, more preferably equal to or greater than 0.2 mm, and particularly preferably equal to or greater than 0.3 mm.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the cover 12 in an adequate amount.

For forming the cover 12, known methods such as injection molding, compression molding, cast molding and the like can be used. When forming the cover 12, the dimples 14 are formed by pimples formed on the cavity face of a mold. The cover 12 may be formed by applying the solution or dispersion liquid of the resin composition to the surface of the reinforcing layer 10. A sphere with the cover 12 having a smooth surface from the above application may be formed, and placed into a mold to form the dimples 14 thereon.

The golf ball 2 satisfies the following mathematical formula.

$$Hs>Hm>Hc$$

Hs: Shore D hardness of the envelope layer 6

Hm: Shore D hardness of the mid layer 8

Hc: Shore D hardness of the cover 12

In the golf ball 2, the hardness Hs of the envelope layer 6 is great. The envelope layer 6 achieves an outer-hard/inner-soft structure. The envelope layer 6 suppresses the spin when the golf ball 2 is hit with a driver. The envelope layer 6 contributes to the flight performance upon a shot with a driver. In the golf ball 2, the hardness Hc of the cover 12 is small. When the golf ball 2 with the cover 12 is hit with a short iron, a high spin rate is obtained. The cover 12 contributes to the controllability upon a shot with a short iron. In the golf ball 2, the hardness Hm of the mid layer 8 is between the hardness Hs of the envelope layer 6 and the hardness Hc of the cover 12. If the mid layer 8 is not provided, the hardness distribution has a great step at the boundary between the envelope layer 6 and the cover 12. In the golf ball 2 with the mid layer 8, the hardness distribution does not have such a great step. The mid layer 8 contributes to the feel at impact. The golf ball 2 has excellent flight performance, excellent controllability and excellent feel at impact.

In light of feel at impact, the golf ball 2 has an amount of compressive deformation D4 of preferably 1.9 mm or greater, more preferably 2.0 mm or greater, and particularly preferably 2.1 mm or greater. In light of resilience performance, the amount of compressive deformation D4 is preferably equal to or less than 3.5 mm, more preferably equal to or less than 3.0 mm, and particularly preferably equal to or less than 2.7 mm.

In light of flight performance, controllability and feel at impact, the difference (Hs−Hm) between the hardness Hs and the hardness Hm is preferably equal to or greater than 3 and equal to or less than 30, more preferably equal to or greater than 4 and equal to or less than 20, and particularly preferably equal to or greater than 4 and equal to or less than 10.

In light of flight performance, controllability and feel at impact, the difference (Hm−Hc) between the hardness Hm and the hardness HEc is preferably equal to or greater than 5 and equal to or less than 35, more preferably equal to or greater than 10 and equal to or less than 30, and particularly preferably equal to or greater than 15 and equal to or less than 25.

In light of flight performance upon a shot with a driver, the sum (Tm+Tc) of the thickness Tm of the mid layer 8 and the thickness Tc of the cover 12 is preferably equal to or less than 1.6 mm, more preferably equal to or less than 1.4 mm, and particularly preferably equal to or less than 1.2 mm. In light of ease of producing the mid layer 8 and the cover 12, the sum (Tm+Tc) is preferably equal to or greater than 0.2 mm and more preferably equal to or greater than 0.3 mm.

EXAMPLES

Example 1

A rubber composition (b) was obtained by kneading 100 parts by weight of a high-cis polybutadiene (trade name "BR-730", available from JSR Corporation), 35 parts by weight of zinc diacrylate, 5 parts by weight of zinc oxide, an appropriate amount of barium sulfate, 0.5 part by weight of diphenyl disulfide, and 0.8 part by weight of dicumyl peroxide (available from NOF Corporation). This rubber composition (b) was placed into a mold including upper and lower mold halves each having a hemispherical cavity, and heated at 170° C. for 18 minutes to obtain a core with a diameter of 37.9 mm. The amount of barium sulfate was adjusted such that the weight of a golf ball was 45.6 g.

A resin composition (D) was obtained by kneading 50 parts by weight of an ionomer resin (the aforementioned "Himilan 1605"), 50 parts by weight of another ionomer resin (the aforementioned "Himilan AM7329"), and 4 parts by weight of titanium dioxide with a twin-screw kneading extruder. The core was covered with this resin composition (D) by injection molding to form an envelope layer with a thickness of 1.2 mm.

A resin composition (G) was obtained by kneading 46 parts by weight of an ionomer resin (the aforementioned "Himilan 1555"), 46 parts by weight of another ionomer resin (the aforementioned "Himilan 1557"), 8 parts of a styrene block-containing thermoplastic elastomer (the aforementioned "Rabalon T3221C"), and 4 parts by weight of titanium dioxide with a twin-screw kneading extruder. The envelope layer was covered with this resin composition (G) by injection molding to form a mid layer with a thickness of 0.6 mm.

A paint composition (trade name "POLIN 750LE", available from SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 5 parts by weight of titanium oxide, and 55 parts by weight of a solvent. The weight ratio of the base material liquid to the curing agent liquid is 1/1. This paint composition was applied to the surface of the mid layer with a spray gun, and maintained at 23° C. for 6 hours to obtain a reinforcing layer with a thickness of 10 μm.

A resin composition (B) was obtained by kneading 100 parts by weight of a thermoplastic polyurethane elastomer (the aforementioned "Elastollan XNY90A") and 4 parts by weight of titanium dioxide with a twin-screw kneading extruder. Two half shells were obtained from this resin composition (B) by compression molding. The sphere consisting of the core, the envelope layer, the mid layer, and the reinforcing layer was covered with these two half shells. The half shells and the sphere were placed into a final mold that includes upper and lower mold halves each having a hemispherical cavity and that has a large number of pimples on its cavity face, and compression molding was performed to form a cover with a thickness of 0.6 mm. A large number of dimples having a shape that is the inverted shape of the shape of the pimples were formed on the cover. A clear paint including a two-component curing type polyurethane as a base material was applied to this cover to obtain a golf ball of Example 1 with a diameter of 42.7 mm and a weight of 45.6 g.

Examples 2 to 5 and Comparative Examples 1 to 7

Golf balls of Examples 2 to 5 and Comparative Examples 1 to 7 were obtained in a similar manner as Example 1, except the specifications of the core, the envelope layer, the mid layer and the cover were as shown in the following Tables 3 to 5. The rubber composition of the core is shown in detail in the following Table 1. The resin compositions of the envelope layer, the mid layer and the cover are shown in detail in the following Table 2. The golf ball of Comparative Example 1 does not have a mid layer.

[Shot with Driver (W#1)]

A driver with a titanium head (trade name "SRIXON W505", available from SRI Sports Limited, shaft hardness: X, loft angle: 8.50) was attached to a swing machine available from Golf Laboratories, Inc. A golf ball was hit under the condition of a head speed of 50 m/sec, and the distance from the launch point to the stop point was measured. In addition, the backspin rate was measured immediately after the hit. The average value of data obtained by 12 measurements is shown in the following Tables 3 to 5.

[Shot with Sand Wedge (SW)]

A sand wedge was attached to a swing machine available from True Temper Co. A golf ball was hit under the condition of a head speed of 21 m/sec, and the backspin rate was measured. The average value of data obtained by 12 measurements is shown in the following Tables 3 to 5.

[Feel at Impact]

Ten golf players hit golf balls with drivers, and were asked about feel at impact. The evaluation was categorized as follows based on the number of golf players who answered, "the impact shock was small and the feel at impact was excellent".

A: 8 or more

B: 6 to 7

C: 4 to 5

D: 3 or less

The results are shown in the following Tables 3 to 5.

TABLE 1

Composition of Core

| | (a) | (b) |
|---|---|---|
| | | (parts by weight) |
| Polybutadiene | 100 | 100 |
| Zinc diacrylate | 40 | 35 |
| Zinc oxide | 5 | 5 |
| Barium sulfate | Appropriate amount | Appropriate amount |
| Diphenyl disulfide | 0.5 | 0.5 |
| Dicumyl peroxide | 0.8 | 0.8 |

TABLE 2

Compositions of Envelope Layer, Mid Layer and Cover

| | (A) | (B) | (C) | (D) | (E) | (F) | (G) | (H) | (I) | (J) |
|---|---|---|---|---|---|---|---|---|---|---|
| | | | | | | | | | | (parts by weight) |
| Elastollan XNY97A | 100 | — | — | — | — | — | — | — | — | — |
| Elastollan XNY90A | — | 100 | — | — | — | — | — | — | — | — |
| Elastollan XNY80A | — | — | 100 | — | — | — | — | — | — | — |
| Himilan 1605 | — | — | — | 50 | — | — | — | 5 | 5 | 50 |
| Himilan AM7329 | — | — | — | 50 | — | 40 | — | — | — | 50 |
| Surlyn 8140 | — | — | — | — | 50 | — | — | — | — | — |
| Surlyn 9120 | — | — | — | — | 50 | — | — | — | — | — |
| Surlyn 8945 | — | — | — | — | — | 57 | — | — | — | — |
| Himilan 1555 | — | — | — | — | — | — | 46 | 10 | 10 | — |
| Himilan 1557 | — | — | — | — | — | — | 46 | — | — | — |
| Himilan 1855 | — | — | — | — | — | — | — | 55 | 50 | — |
| Surlyn 6320 | — | — | — | — | — | — | — | 30 | 35 | — |
| Rabalon T3221C | — | — | — | — | — | 3 | 8 | — | — | — |
| Titanium dioxide | 4 | 4 | 4 | 14 | 4 | 4 | 4 | 4 | 4 | 4 |
| Hardness (Shore D) | 47 | 38 | 26 | 67 | 70 | 61 | 57 | 52 | 48 | 65 |

TABLE 3

Results of Evaluation

| | | Example 1 | Example 2 | Example 3 | Example 4 |
|---|---|---|---|---|---|
| Core | Composition | (b) | (a) | (b) | (a) |
| | Diameter (mm) | 37.9 | 38.5 | 38.7 | 37.3 |
| | Deformation D1 (mm) | 3.1 | 2.6 | 3.1 | 2.6 |
| | Surface hardness (JIS C) | 83 | 85 | 83 | 85 |
| Envelope layer | Composition | (D) | (D) | (F) | (F) |
| | Thickness Ts (mm) | 1.2 | 1.0 | 0.8 | 1.4 |
| | Hardness Hs (Shore D) | 67 | 67 | 61 | 61 |
| Mid layer | Composition | (G) | (G) | (G) | (G) |
| | Thickness Tm (mm) | 0.6 | 0.8 | 0.7 | 0.9 |
| | Hardness Hm (Shore D) | 57 | 57 | 57 | 52 |
| Cover | Composition | (B) | (C) | (C) | (B) |
| | Thickness Tc (mm) | 0.6 | 0.3 | 0.5 | 0.4 |
| | Hardness Hc (Shore D) | 38 | 26 | 26 | 38 |
| Ball W#1 | Deformation D4 (mm) | 2.6 | 2.1 | 2.7 | 2.2 |
| | Spin (rpm) | 2100 | 2300 | 2450 | 2500 |
| | Flight distance (m) | 276.0 | 276.5 | 272.5 | 273.5 |
| SW | Spin (rpm) | 6800 | 7100 | 7250 | 7200 |
| | Feel at impact | B | A | A | A |

TABLE 4

Results of Evaluation

| | | Example 5 | Compa. Example 1 | Compa. Example 2 | Compa. Example 3 |
|---|---|---|---|---|---|
| Core | Composition | (a) | (b) | (a) | (b) |
| | Diameter (mm) | 38.5 | 38.9 | 37.7 | 36.5 |
| | Deformation D1 (mm) | 2.6 | 3.1 | 2.6 | 3.1 |
| | Surface hardness (JIS C) | 85 | 83 | 85 | 83 |
| Envelope layer | Composition | (E) | (F) | (D) | (D) |
| | Thickness Ts (mm) | 1.0 | 1.2 | 1.2 | 1.1 |
| | Hardness Hs (Shore D) | 70 | 61 | 67 | 67 |
| Mid layer | Composition | (G) | — | (G) | (G) |
| | Thickness Tm (mm) | 0.8 | — | 0.8 | 1.4 |
| | Hardness Hm (Shore D) | 57 | — | 57 | 57 |
| Cover | Composition | (C) | (C) | (A) | (C) |
| | Thickness Tc (mm) | 0.3 | 0.7 | 0.5 | 0.6 |
| | Hardness Hc (Shore D) | 26 | 26 | 47 | 26 |
| Ball W#1 | Deformation D4 (mm) | 2.0 | 2.8 | 2.0 | 2.5 |
| | Spin (rpm) | 2250 | 2600 | 2150 | 2750 |
| | Flight distance (m) | 277.0 | 270.5 | 277.5 | 269.5 |
| SW | Spin (rpm) | 7000 | 6750 | 6550 | 7450 |
| | Feel at impact | A | B | C | A |

TABLE 5

Results of Evaluation

| | | Compa. Example 4 | Compa. Example 5 | Compa. Example 6 | Compa. Example 7 |
|---|---|---|---|---|---|
| Core | Composition | (a) | (b) | (a) | (b) |
| | Diameter (mm) | 38.3 | 37.9 | 38.3 | 37.9 |
| | Deformation D1 (mm) | 2.6 | 3.1 | 2.6 | 3.1 |
| | Surface hardness (JIS C) | 85 | 83 | 85 | 83 |
| Envelope layer | Composition | (G) | (G) | (F) | (F) |
| | Thickness Ts (mm) | 1.0 | 1.2 | 1.0 | 1.2 |
| | Hardness Hs (Shore D) | 57 | 57 | 61 | 60 |
| Mid layer | Composition | (D) | (H) | (I) | (J) |
| | Thickness Tm (mm) | 0.9 | 0.8 | 0.9 | 0.8 |
| | Hardness Hm (Shore D) | 67 | 52 | 48 | 65 |
| Cover | Composition | (B) | (B) | (B) | (B) |
| | Thickness Tc (mm) | 0.3 | 0.4 | 0.3 | 0.4 |
| | Hardness Hc (Shore D) | 38 | 38 | 38 | 38 |
| Ball W#1 | Deformation D4 (mm) | 2.1 | 2.9 | 2.2 | 2.7 |
| | Spin (rpm) | 2050 | 2850 | 2150 | 1900 |
| | Flight distance (m) | 278.0 | 266.5 | 276.5 | 274.5 |
| SW | Spin (rpm) | 6450 | 7400 | 6650 | 6250 |
| Feel at impact | | D | A | A | D |

As shown in Tables 3 to 5, the golf balls of Examples are excellent for all the evaluation items. From the results of evaluation, advantages of the present invention are clear.

The golf ball according to the present invention can be used for playing golf on a golf course and practicing at a driving range. The above description is merely for illustrative examples, and various modifications can be made without departing from the principles of the present invention.

What is claimed is:

1. A golf ball comprising a core, an envelope layer positioned outside the core, a mid layer positioned outside the envelope layer, and a cover positioned outside the mid layer, wherein: the difference (H2−H1) between a surface hardness H2 and a central hardness H1 of the core, which are measured with a JIS-C type hardness scale, is equal to or greater than 5 and equal to or less than 35, the mid layer has a thickness Tm less than 1.0 mm;

the cover has a thickness Tc of 0.5 mm or less;

the envelope layer has a Shore D hardness Hs of 60 or greater, and a principal component of a base material of the envelope layer is an ionomer resin;

the mid layer has a Shore D hardness Hm of 50 or greater and 65 or less, and a principal component of a base material of the mid layer is an ionomer resin;

the cover has a Shore D hardness Hc less than 40, and a principal component of a base material of the cover is a polyurethane; and the hardness Hs, the hardness Hm and the hardness He satisfy the following mathematical formula:

$$Hs>Hm>Hc.$$

2. The golf ball according to claim 1, wherein the core has a diameter of 35.0 mm or greater and 42.0 mm or less.

3. The golf ball according to claim 1, wherein the envelope layer has a thickness Ts of 1.4 mm or greater and 2.4 mm or less.

4. The golf ball according to claim 1, wherein the sum (Tm+Tc) of the thickness Tm of the mid layer and the thickness Tc of the cover is equal to or greater than 0.2 mm and equal to or less than 1.6 mm.

5. The golf ball according to claim 1, wherein:

the core is formed by crosslinking a rubber composition; and the principal component of the base material of the rubber composition is a polybutadiene.

6. The golf ball according to claim 5, wherein the core has a central hardness H1 of 35 or greater and 80 or less, which is measured with a JIS-C type hardness scale.

7. The golf ball according to claim 6, wherein the core has a surface hardness H2 of 45 or greater and 100 or less, which is measured with a JIS-C type hardness scale.

8. The golf ball according to claim 1, wherein the principal component of the base material of the cover is a thermoplastic polyurethane elastomer.

9. The golf ball according to claim 1, wherein the hardness Hs is greater than a surface hardness of the core.

10. The golf ball according to claim 1, wherein the difference (Hs−Hm) between the hardness Hs and the hardness Hm is equal to or greater than 3 and equal to or less than 30.

11. The golf ball according to claim 1, wherein the difference (Hm−Hc) between the hardness Hm and the hardness Hc is equal to or greater than 5 and equal to or less than 35.

12. The golf ball according to claim 1, wherein the core has an amount of compressive deformation D1 of 2.3 mm or greater and 5.0 mm or less.

13. The golf ball according to claim 1, wherein a sphere consisting of the core and the envelope layer has an amount of compressive deformation of 2.0 mm or greater and 3.8 mm or less.

14. The golf ball according to claim 1, wherein a sphere consisting of the core, the envelope layer and the mid layer has an amount of compressive deformation of 2.3 mm or greater and 4.0 mm or less.

15. The golf ball according to claim 1, wherein the golf ball has an amount of compressive deformation of 1.9 mm or greater and 3.5 mm or less.

16. The golf ball according to claim 1, further comprising a reinforcing layer positioned between the mid layer and the cover, wherein the reinforcing layer has a thickness of 3 μm or greater and 30 μm or less.

* * * * *